US010937367B2

(12) United States Patent
Xuan et al.

(10) Patent No.: US 10,937,367 B2
(45) Date of Patent: Mar. 2, 2021

(54) PIXEL CIRCUIT AND DRIVING METHOD THEREFOR, AND DISPLAY PANEL

(71) Applicant: BOE TECHNOLOGY GROUP CO., LTD., Beijing (CN)

(72) Inventors: Minghua Xuan, Beijing (CN); Xiaochuan Chen, Beijing (CN); Shengji Yang, Beijing (CN); Pengcheng Lu, Beijing (CN); Lei Wang, Beijing (CN); Jie Fu, Beijing (CN); Li Xiao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 196 days.

(21) Appl. No.: 16/330,639

(22) PCT Filed: Apr. 11, 2018

(86) PCT No.: PCT/CN2018/082632
§ 371 (c)(1),
(2) Date: Mar. 5, 2019

(87) PCT Pub. No.: WO2018/223767
PCT Pub. Date: Dec. 13, 2018

(65) Prior Publication Data

US 2021/0005143 A1 Jan. 7, 2021

(30) Foreign Application Priority Data

Jun. 8, 2017 (CN) ..... 201710428659.0

(51) Int. Cl.
*G09G 3/3233* (2016.01)
*G09G 3/3258* (2016.01)

(52) U.S. Cl.
CPC ... *G09G 3/3258* (2013.01); *G09G 2300/0426* (2013.01); *G09G 2310/0286* (2013.01); *G09G 2310/08* (2013.01); *G09G 2320/0233* (2013.01)

(58) Field of Classification Search
CPC ..... G09G 3/3233; G09G 2300/0819; G09G 2300/0861; G09G 2310/0262;
(Continued)

(56) References Cited

U.S. PATENT DOCUMENTS

2011/0193855 A1 8/2011 Han
2015/0009199 A1 1/2015 In et al.
(Continued)

FOREIGN PATENT DOCUMENTS

CN 103531148 A 1/2014
CN 203882587 U 10/2014
(Continued)

OTHER PUBLICATIONS

International Search Report and Written Opinion issued in International Patent Application No. PCT/CN2018/082632, dated Jul. 2, 2018; with English translation.
(Continued)

*Primary Examiner* — Ram A Mistry
(74) *Attorney, Agent, or Firm* — McDermott Will & Emery LLP

(57) ABSTRACT

A pixel circuit and a driving method therefor, and a display panel. The circuit includes: a node control circuit, a driver, a display sub-circuit, a threshold compensator, and a reset device; the node control circuit outputs a reference voltage to a first node, or outputs a data voltage to the first node. The driver outputs a drive current; the display sub-circuit is configured to display a gray scale; the threshold compensator is configured to adjust a voltage of a second node to the
(Continued)

sum of a voltage of a first level terminal and a threshold voltage of the driver, and adjust the voltage of the second node to a difference between the sum of the voltage of the first level signal, the threshold voltage of the driver, and the reference voltage and the data voltage; and the reset device is configured to reset the second node and the display sub-circuit.

15 Claims, 3 Drawing Sheets

(58) Field of Classification Search
CPC ..... G09G 3/3258; G09G 2320/045; G09G 3/3225; G09G 3/3266; G09G 2310/0251; G09G 2300/0852; G09G 2320/0233; G09G 2320/043; G09G 3/3208; G09G 2300/0809; G09G 2300/0842; G09G 2330/028; G09G 2230/00; G09G 2300/0814; G09G 2300/0866; G09G 2310/0216; G09G 2310/0218; G09G 2310/0264; G09G 2310/0278; G09G 2310/0286; G09G 2310/0297; G09G 2310/08; G09G 2320/0204; G09G 2320/0223; G09G 2320/0693; G09G 3/2003; G09G 2300/0426; G09G 2310/061; G09G 2320/0633; G09G 2330/027; G09G 2330/04; G09G 3/32; G09G 3/3275; G09G 3/3291; C08F 265/06; C08F 220/1804; C08F 212/08; C08F 220/14; C08F 220/18; C08L 27/06; C08L 2201/08; C08L 51/003; H01L 51/5206; H01L 51/5221; H01L 27/32; H01L 27/3202; H01L 27/3276; H01L 51/56; G06F 1/1686; G06F 1/1694; G06F 3/016; G06F 3/017; G06F 40/103; G06F 40/166; G06F 40/177
See application file for complete search history.

(56) References Cited

U.S. PATENT DOCUMENTS

| | | | |
|---|---|---|---|
| 2015/0325169 | A1 | 11/2015 | Qing et al. |
| 2016/0155379 | A1 | 6/2016 | Na |
| 2016/0240134 | A1 | 8/2016 | Yang et al. |
| 2016/0253959 | A1 | 9/2016 | Sun et al. |
| 2016/0275869 | A1 | 9/2016 | Hwang et al. |
| 2018/0096653 | A1 | 4/2018 | He et al. |
| 2018/0211600 | A1 | 7/2018 | Nie |
| 2018/0315374 | A1 | 11/2018 | Zhang et al. |

FOREIGN PATENT DOCUMENTS

| | | | |
|---|---|---|---|
| CN | 104575378 | A | 4/2015 |
| CN | 104599638 | A | 5/2015 |
| CN | 204315211 | U | 5/2015 |
| CN | 105225636 | A | 1/2016 |
| CN | 105489163 | A | 4/2016 |
| CN | 106097964 | A | 11/2016 |
| CN | 205920745 | U | 2/2017 |
| CN | 106504700 | A | 3/2017 |
| CN | 107204173 | A | 9/2017 |

OTHER PUBLICATIONS

Chinese First Office Action issued in Chinese Patent Application No. 201710428659.0, dated Jan. 9, 2019; with English translation

PIXEL CIRCUIT AND DRIVING METHOD THEREFOR, AND DISPLAY PANEL

CROSS-REFERENCE TO RELATED APPLICATION

This application is a national phase entry under 35 USC 371 of International Patent Application No. PCT/CN2018/082632 filed on Apr. 11, 2018, which claims priority to Chinese Patent Application No. 201710428659.0, submitted to Chinese Patent Office on Jun. 8, 2017, titled "A PIXEL CIRCUIT AND DRIVING METHOD THEREFOR, AND DISPLAY PANEL", which are incorporated herein by reference in their entirety.

TECHNICAL FIELD

The present disclosure relates to the field of display technologies, and in particular, to a pixel circuit and a method of driving the same, and a display panel.

BACKGROUND

In an organic light-emitting display (OLED) panel with a substrate made of low temperature polysilicon (LTPS), since the LTPS crystal particles are irregular, it is necessary to perform pixel compensation for each pixel in the OLED panel, so as to eliminate a problem that a luminance of pixels is uneven due to unevenness of the LTPS crystal particles on a channel of each driving thin film transistor (DTFT).

SUMMARY

In a first aspect, embodiments of the present disclosure provide a pixel circuit, and the pixel circuit includes a node control circuit, a driver, a display sub-circuit, a threshold compensator, and a reset device.

The node control circuit is configured to receive a first scanning signal, a second scanning signal, a third scanning signal, a reference voltage, and a data voltage. The node control circuit is further configured to output the reference voltage to a first node under the control of a voltage of the first scanning signal or a voltage of the second scanning signal, or to output the data voltage to the first node under the control of a voltage of the third scanning signal.

The driver is configured to receive a first level signal at an input terminal of the driver. The driver is further configured to output a driving current at an output terminal of the driver under the control of a voltage of the first level signal and a voltage of the second node.

The display sub-circuit is coupled to the reset device and the output terminal of the driver. The display sub-circuit is configured to receive a second level signal and the second scanning signal. The display sub-circuit is further configured to display a gray-scale by the driving current under the control of the voltage of the second scanning signal.

The threshold compensator is coupled to the first node, the output terminal of the driver, and the second node. The threshold compensator is configured to receive the third scanning signal and a fourth scanning signal. The threshold compensator is further configured to adjust the voltage of the second node to a sum of the voltage of the first level signal and a threshold voltage of the driver under the control of the voltage of the third scanning signal or a voltage of the fourth scanning signal, and to adjust the voltage of the second node to a difference between a sum of the voltage of the first level signal, the threshold voltage of the driver and the reference voltage, and the data voltage under the control of a voltage of the first node and a voltage of the output terminal of the driver.

The reset device is coupled to the second node and the display sub-circuit. The reset device is configured to receive a reset voltage signal, the first scanning signal and the third scanning signal. The reset device is further configured to reset the second node by a voltage of the reset voltage signal under the control of the voltage of the first scanning signal, and to reset the display sub-circuit by the voltage of the reset voltage signal under the control of the voltage of the third scanning signal.

The first node is an intersection of an output of the node control circuit and an input of the threshold compensator.

The second node is an intersection of an output of the threshold compensator, an input of the driver, and an output of the reset device.

Optionally, the node control circuit includes a first transistor, a second transistor, and a third transistor.

The first transistor is configured to receive the reference voltage at a first electrode of the first transistor. A second electrode of the first transistor is coupled to the first node. The first transistor is configured to receive the first scanning signal at a gate of the first transistor.

The second transistor is configured to receive the reference voltage at a first electrode of the second transistor. A second electrode of the second transistor is coupled to the first node. The second transistor is configured to receive the second scanning signal at a gate of the second transistor.

The third transistor is configured to receive the data voltage at a first electrode of the third transistor. A second electrode of the third transistor is coupled to the first node. The third transistor is configured to receive the third scanning signal at a gate of the third transistor.

Optionally, the threshold compensator includes a fourth transistor, a fifth transistor, and a first capacitor.

A first electrode of the fourth transistor is coupled to the output terminal of the driver, and a second electrode of the fourth transistor is coupled to the second node. The fourth transistor is configured to receive the third scanning signal at a gate of the fourth transistor.

A first electrode of the fifth transistor is coupled to the output terminal of the driver, and a second electrode of the fifth transistor is coupled to the second node. The fifth transistor is configured to receive the fourth scanning signal at a gate of the fifth transistor.

A first electrode of the first capacitor is coupled to the first node, and a second electrode of the first capacitor is coupled to the second node.

Optionally, the fourth transistor and the fifth transistor share a source, a drain, and an active layer.

The gate of the fourth transistor and the gate of the fifth transistor are respectively located on both sides of the active layer.

Optionally, a projection of the gate of the fourth transistor in a direction perpendicular to the active layer and a projection of the gate of the fifth transistor in a direction perpendicular to the active layer coincide with each other.

Optionally, a first insulating layer is further disposed between the gate of the fifth transistor and the active layer. A second insulating layer is further disposed between the gate of the fourth transistor and the active layer. A third insulating layer is further disposed between the gate of the fourth transistor and both the source and the drain. The source and the drain are in contact with the active layer through through-holes penetrating the second insulating layer and the third insulating layer.

Optionally, the first electrode of the first capacitor and the gate of the fourth transistor are formed by a same patterning process, and the second electrode of the first capacitor and the gate of the fifth transistor are formed by a same patterning process.

Alternatively, the first electrode of the first capacitor and the gate of the fifth transistor are formed by a same patterning process, and the second electrode of the first capacitor and the gate of the fourth transistor are formed by a same patterning process.

Optionally, the reset device includes a sixth transistor and a seventh transistor.

The sixth transistor is configured to receive the reset voltage signal at a first electrode of the sixth transistor. A second electrode of the sixth transistor is coupled to the second node. The sixth transistor is configured to receive the first scanning signal at a gate of the sixth transistor.

The seventh transistor is configured to receive the reset voltage signal at a first electrode of the seventh transistor. A second electrode of the seventh transistor is coupled to the display sub-circuit. The seventh transistor is configured to receive the third scanning signal at a gate of the seventh transistor.

Optionally, the driver is a driving transistor, the input terminal of the driver is a source of the driving transistor, the control terminal of the driver is a gate of the driving transistor, and the output terminal of the driver is a drain of the driving transistor.

Optionally, the display sub-circuit includes an eighth transistor and a light-emitting diode.

A first electrode of the eighth transistor is coupled to the output terminal of the driver, and a second electrode of the eighth transistor is coupled to an anode of the light-emitting diode. The eighth transistor is configured to receive the second scanning signal at a gate of the eighth transistor.

A cathode of the light-emitting diode is configured to receive the second level signal.

Optionally, the third scanning signal is an output signal of an nth-stage shift register in a shift register circuit. The fourth scanning signal is an output signal of an (n+1)th-stage shift register in the shift register circuit, and n is an positive integer.

In a second aspect, a method of driving a pixel circuit is provided. The method is used for driving any one of the pixel circuits according to the first aspect. The method includes:

in a first period, outputting, by the node control circuit, the reference voltage to the first node under the control of the voltage of the first scanning signal; and resetting, by the reset device, the second node by the voltage of the reset voltage signal under the control of the voltage of the first scanning signal;

in a second period, outputting, by the node control circuit, the data voltage to the first node under the control of the voltage of the third scanning signal; adjusting, by the threshold compensator, the voltage of the second node to the sum of the voltage of the first level signal and the threshold voltage of the driver; and resetting, by a reset module, the display sub-circuit by the voltage of the reset voltage signal under the control of the voltage of the third scanning signal;

in a third period, adjusting, by the threshold compensator, the voltage of the second node to the sum of the voltage of the first level signal and the threshold voltage of the driver under the control of the voltage of the fourth scanning signal; and in a fourth period, outputting, by the node control circuit, the reference voltage to the first node under the control of the voltage of the second scanning signal; adjusting, by the threshold compensator, the voltage of the second node to the difference between the sum of the voltage of the first level signal, the threshold voltage of the driver and the reference voltage, and the data voltage under the control of the voltage of the first node and the voltage of the output terminal of the driver; outputting, by the driver, the driving current at the output terminal of the driver under the control of the voltage of the first level signal and the voltage of the second node; and driving, by the display sub-circuit, to display a gray-scale by the driving current under the control of the voltage of the second scanning signal.

In a third aspect, a display panel is provided. The display panel includes pixel circuits described above.

BRIEF DESCRIPTION OF THE DRAWINGS

In order to describe technical solutions in embodiments of the present disclosure more clearly, the accompanying drawings to be used in the description of embodiments will be introduced briefly. Obviously, the accompanying drawings to be described below are merely some embodiments of the present disclosure, and a person of ordinary skill in the art may obtain other drawings according to these drawings without paying any creative effort.

DETAILED DESCRIPTION

Figure 1:
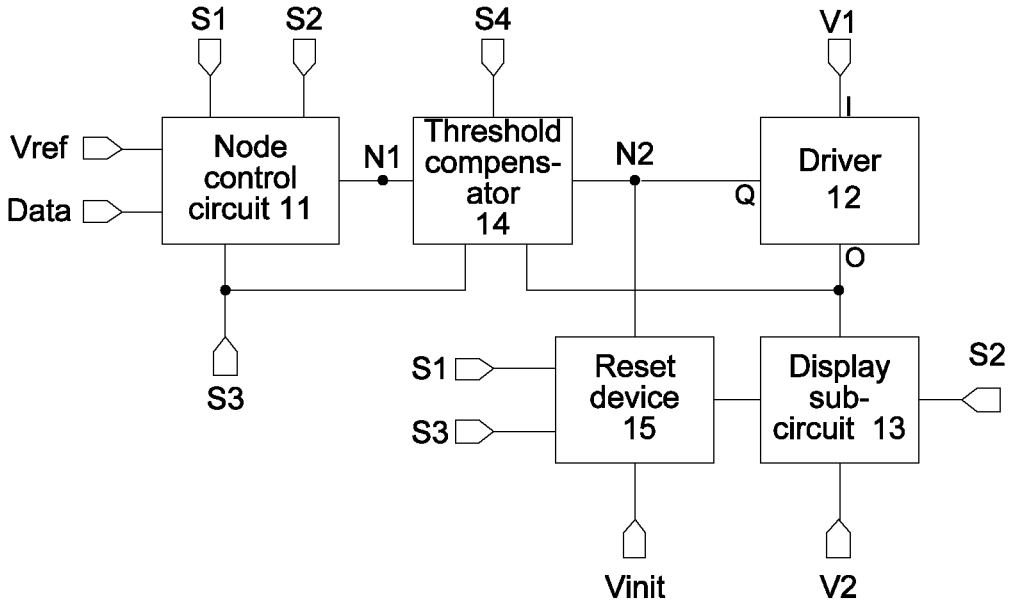
FIG. 1 is a structural schematic diagram of a pixel circuit according to embodiments of the present disclosure.

The technical solutions in embodiments of the present disclosure will be described clearly and completely with reference to the accompanying drawings in embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

Transistors used in all embodiments of the present disclosure may be thin film transistors or field-effect transistors or other devices having the same properties. The transistors used in embodiments of the present disclosure mainly include switching transistors and driving transistors depending on functions of the transistors in the circuit. Since a source and a drain of a switching transistor used herein are symmetrical, the source and the drain are interchangeable. In embodiments of the present disclosure, in order to distinguish between two electrodes of a transistor other than a gate, one electrode is referred to as a source, and another electrode is referred to as a drain. According to the accompanying drawings, a middle terminal of the transistor is defined as a gate, a signal input terminal of the transistor is defined as a source, and a signal output terminal of the transistor is defined as a drain. In addition, the switching transistors used in embodiments of the present disclosure include P-type switching transistors and N-type switching transistors. A P-type switching transistor is turned on when the gate is at a low level, and is cut off when the gate is at a high level. An N-type switching transistor is turned on when the gate is at a high level, and is cut off when the gate is at a low level. The driving transistors include P-type driving transistors and N-type driving transistors. A P-type driving transistor is in an amplified state or a saturated state when a gate voltage on a gate of the P-type driving transistor is at a low level (the gate voltage is smaller than a source voltage) and an absolute value of a difference between the gate voltage and the source voltage is greater than a threshold voltage. The N-type driving transistor is in an amplified state or a saturated state when a gate voltage on a gate of the N-type driving transistor is at a high level (the gate voltage is greater than a source voltage) and an absolute value of a difference between the gate voltage and the source voltage is greater than a threshold voltage.

It will be further noted that, in order to facilitate clear description of technical solutions of the embodiments of the present disclosure, in embodiments of the present disclosure, words "first", "second", etc. are used to distinguish between same or similar items whose functions and roles are substantially the same. Those skilled in the art will understand that the words "first", "second", etc. are not intended to limit a quantity or an order of execution.

The inventors have known that as a resolution of the OLED panel increases, an allocated read time for the threshold voltage of the DTFT of each pixel is continuously shortened. For example, when the resolution of a display panel is 1440*2560 and a frequency of the display panel is 60 HZ, the read time of the threshold voltage of the DTFT of each pixel is: 1 s divided by 60 HZ divided by 2560 being 6.5 μs (1 s÷60 HZ÷2560=6.5 μs). In addition, except for a rise time and a fall time of a waveform, the read time of the threshold voltage of the DTFT of each pixel is less than 5 μs, and the higher the resolution, the shorter the read time of the threshold voltage of the DTFT of each pixel. Since the allocated read time for the threshold voltage of the DTFT of each pixel is continuously shortened, a pixel circuit may not be able to read the threshold voltage of the DTFT, which may result in uneven display and mura.

Embodiments of the present disclosure provide a pixel circuit.

Referring to FIG. 1, the pixel circuit includes a node control circuit 11, a driver 12, a display sub-circuit 13, a threshold compensator 14, and a reset device 15.

The node control circuit 11 is configured to receive a first scanning signal S1, a second scanning signal S2, a third scanning signal S3, a reference voltage Vref and a data voltage Vdata. The node control circuit 11 is further configured to output the reference voltage Vref to a first node N1 under the control of a voltage of the first scanning signal S1 or a voltage of the second scanning signal S2, or to output the data voltage Vdata to the first node N1 under the control of a voltage of the third scanning signal S3.

The driver 12 is configured to receive a first level signal V1 at its input terminal I, and a control terminal Q of the driver 12 is coupled to a second node N2. The driver 12 is further configured to output a driving current at an output terminal O of the driver 12 under the control of a voltage of the first level signal V1 and a voltage of the second node N2.

The display sub-circuit 13 is coupled to the reset device 15 and the output terminal O of the driver 12. The display sub-circuit 13 is configured to receive a second level signal V2 and the second scanning signal S2. The display sub-circuit 13 is further configured to display a gray-scale by the driving current under the control of the voltage of the second scanning signal S2.

The threshold compensator 14 is coupled to the first node N1, the output terminal O of driver 12, and the second node N2. The threshold compensator 14 is configured to receive the third scanning signal S3 and a fourth scanning signal S4. The threshold compensator 14 is further configured to adjust the voltage of the second node N2 to a sum of the voltage of the first level signal V1 and a threshold voltage of the driver 12 under the control of the voltage of the third scanning signal S3 or a voltage of the fourth scanning signal S4, and to adjust the voltage of the second node N2 to a difference between a sum of the voltage of the first level signal V1, the threshold voltage of the driver 12 and the reference voltage Vref, and the data voltage Vdata under the control of a voltage of the first node N1 and a voltage of the output terminal O of the driver 12.

The reset device 15 is coupled to the second node N2 and the display sub-circuit 13. The reset device 15 is configured to receive a reset voltage signal Vinit, the first scanning signal S1 and the third scanning signal S3. The reset device 15 is further configured to reset the second node N2 by a voltage of the reset voltage signal Vinit under the control of the voltage of the first scanning signal S1, and to reset the display sub-circuit 13 by means of the voltage of the reset voltage signal Vinit under the control of the voltage of the third scanning signal S3.

It will be understood that, the first node N1 is an intersection of an output of the node control circuit 11 and an input of the threshold compensator 14. The second node N2 is an intersection of an output of the threshold compensator 14, an input of the driver 12, and an output of the reset device 15.

The pixel circuit provided by the embodiments of the present disclosure includes the node control circuit 11, the threshold compensator 14, the reset device 15, the driver 12, and the display sub-circuit 13. The threshold compensator 14 may adjust the voltage of the second node N2 to the sum of the voltage of the first level signal V1 and the threshold voltage of the driver 12 under the control of the voltage of the third scanning signal S3 or the voltage of the fourth scanning signal S4, that is, the pixel circuit provided by the embodiments of the present disclosure may read the threshold voltage of the driver 12 when the third scanning signal or the fourth scanning signal is an effective signal. Therefore, the pixel circuit provided by the embodiments of the present disclosure may increase a length of time that the pixel circuit reads the threshold voltage of the driver, thereby solving a problem that the pixel circuit cannot read the threshold voltage of the driver.

Figure 2:
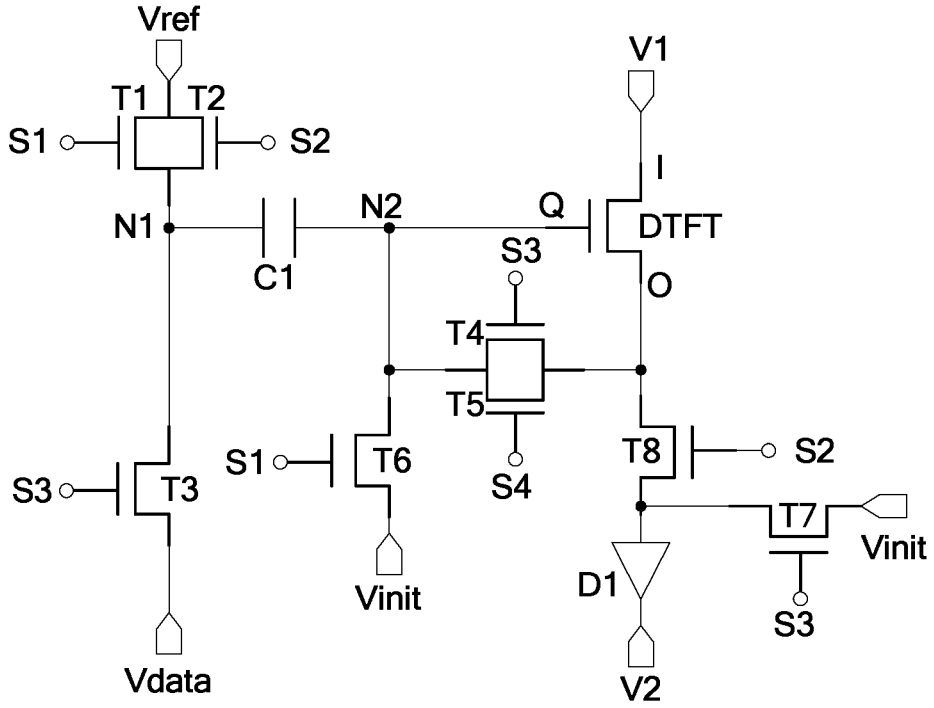
FIG. 2 is a circuit diagram of a pixel circuit according to embodiments of the present disclosure.

Embodiments of the present application further provide a circuit structure of the pixel circuit shown in FIG. 1. Referring to FIG. 2, the node control circuit 11 includes a first transistor T1, a second transistor T2, and a third transistor T3.

The first transistor T1 is configured to receive the reference voltage Vref at a first electrode of the first transistor, a second electrode of the first transistor T1 is coupled to the first node N1, and the first transistor T1 is configured to receive the first scanning signal S1 at a gate of the first transistor.

The second transistor T2 is configured to receive the reference voltage Vref at a first electrode of the second transistor, a second electrode of the second transistor T2 is coupled to the first node N1, and the second transistor T2 is configured to receive the second scanning signal S2 at a gate of the second transistor.

The third transistor T3 is configured to receive the data voltage Vdata at a first electrode of the third transistor, a second electrode of the third transistor T3 is coupled to the first node N1, and the third transistor T3 is configured to receive the third scanning signal S3 at a gate of the third transistor.

The threshold compensator 14 includes a fourth transistor T4, a fifth transistor T5, and a first capacitor C1.

A first electrode of the fourth transistor T4 is coupled to the output terminal O of the driver 12, a second electrode of the fourth transistor T4 is coupled to the second node N2, and the fourth transistor T4 is configured to receive the third scanning signal S3 at a gate of the fourth transistor.

A first electrode of the fifth transistor T5 is coupled to the output terminal O of the driver 12, a second electrode of the fifth transistor T5 is coupled to the second node N2, and the fifth transistor T5 is configured to receive the fourth scanning signal S4 at a gate of the fifth transistor.

A first electrode of the first capacitor C1 is coupled to the first node N1, and a second electrode of the first capacitor C1 is coupled to the second node N2.

The reset device 15 includes a sixth transistor T6 and a seventh transistor T7.

The sixth transistor T6 is configured to receive the reset voltage signal Vinit at a first electrode of the sixth transistor, a second electrode of the sixth transistor T6 is coupled to the second node N2, and the sixth transistor T6 is configured to receive the first scanning signal S1 at a gate of the sixth transistor.

The seventh transistor T7 is configured to receive the reset voltage signal Vinit at a first electrode of the seventh transistor, a second electrode of the seventh transistor T7 is coupled to the display sub-circuit 13, and the seventh transistor T7 is configured to receive the third scanning signal S3 at a gate of the seventh transistor.

The driver 12 is a DTFT, and the input terminal I of the driver 12 is a source of the DTFT, the control terminal Q of the driver 12 is a gate of the DTFT, and the output terminal O of the driver 12 is a drain of the DTFT.

The display sub-circuit 13 includes an eighth transistor T8 and a light-emitting diode D1.

A first electrode of the eighth transistor T8 is coupled to the output terminal O of the driver 12, a second electrode of the eighth transistor T8 is coupled to an anode of the light-emitting diode D1, and the eighth transistor T8 is configured to receive the second scanning signal S2 at a gate of the eighth transistor.

The light-emitting diode D1 is configured to receive the second level signal V2 at a cathode of the light-emitting diode.

Figure 3:
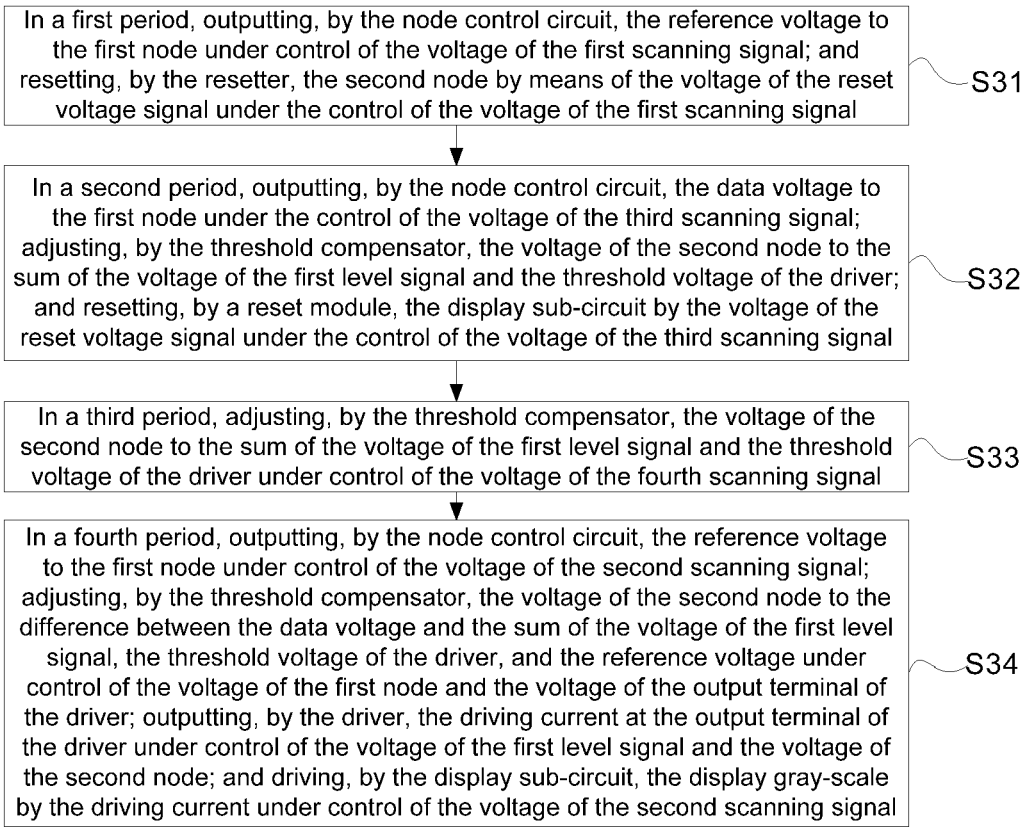
FIG. 3 is a flow chart of a method of driving a pixel circuit according to embodiments of the present disclosure.

Embodiments of the present disclosure further provide a method of driving the pixel circuit described above. Referring to FIG. 3, the method includes the following steps.

At S31, in a first period, the node control circuit outputs the reference voltage to the first node under the control of the voltage of the first scanning signal; and the reset device resets the second node by means of the voltage of the reset voltage signal under the control of the voltage of the first scanning signal.

At S32, in a second period, the node control circuit outputs the data voltage to the first node under the control of the voltage of the third scanning signal; the threshold compensator adjusts the voltage of the second node to the sum of the voltage of the first level signal and the threshold voltage of the driver; and a reset device resets the display sub-circuit by the voltage of the reset voltage signal under the control of the voltage of the third scanning signal.

At S33, in a third period, the threshold compensator adjusts the voltage of the second node to the sum of the voltage of the first level signal and the threshold voltage of the driver under the control of the voltage of the fourth scanning signal.

At S34, in a fourth period, the node control circuit outputs the reference voltage to the first node under the control of the voltage of the second scanning signal; the threshold compensator adjusts the voltage of the second node to the difference between the sum of the voltage of the first level signal, the threshold voltage of the driver and the reference voltage, and the data voltage under the control of the voltage of the first node and the voltage of the output terminal of the driver; the driver outputs the driving current at the output terminal of the driver under the control of the voltage of the first level signal and the voltage of the second node; and the display sub-circuit displays a gray-scale by the driving current under the control of the voltage of the second scanning signal.

Figure 4:
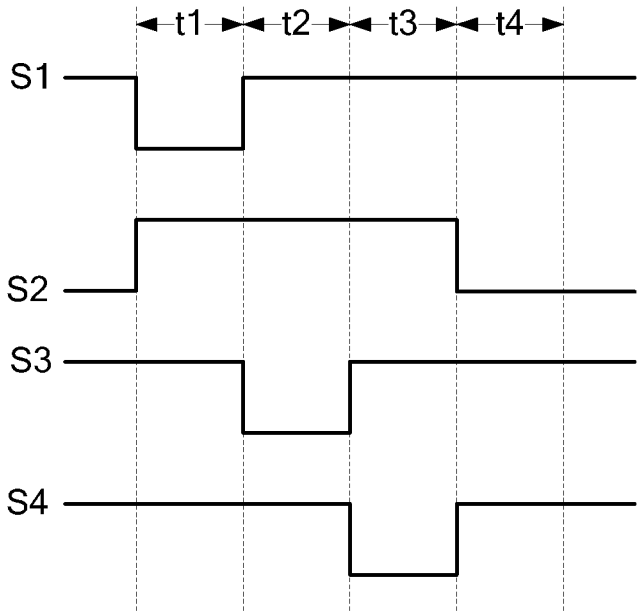
FIG. 4 is a diagram showing timing states of signals of a pixel circuit according to embodiments of the present disclosure.

Operation principles of the pixel circuit shown in FIG. 2 and the method of driving a pixel circuit shown in FIG. 3 will be described below with reference to the timing states of signals shown in FIG. 4. A description is given by taking an example in which all switching transistors in FIG. 2 are P-type transistors that are turned on when the gates thereof are at a low level. FIG. 4 includes signal timing states of the first scanning signal S1, the second scanning signal S2, the third scanning signal S3, and the fourth scanning signal S4. In addition, the first level signal V1 provides a high level Vdd, and the second level signal V2 is grounded to provide Vss. For example, the second level signal V2 may be grounded. As shown in FIG. 4, four timing stages are provided: t1 (a first period), t2 (a second period), t3 (a third period), and t4 (a fourth period).

In the first period, the first scanning signal S1 is at a low level, and the second scanning signal S2, the third scanning signal S3 and the fourth scanning signal S4 are at a high level. Therefore, the first transistor T1 and the sixth transistor T6 are turned on, and other transistors are all cut off. The reference voltage Vref is transmitted to the first node N1 through the first transistor T1. Therefore, the voltage of the first node N1 is the reference voltage Vref in this period. The reset voltage signal Vinit is transmitted to the second node N2 through the sixth transistor T6. Therefore, the voltage of the second node N2 is the voltage of the reset voltage signal Vinit in this period. Meanwhile, since the first electrode and the second electrode of the first capacitor C1 are respectively coupled to the first node N1 and the second node N2, the voltage of the first electrode of the first capacitor C1 is also the reference voltage Vref, and the voltage of the second electrode of the first capacitor C1 is also the voltage of the reset voltage signal Vinit. Since the voltage of the first node N1 and the voltage of the second node N2 are reset to constant voltages in this period, the first period is also referred to as a reset period.

In the second period, the third scanning signal S3 is at a low level, and the first scanning signal S1, the second scanning signal S2 and the fourth scanning signal S4 are at a high level. Therefore, the third transistor T3, the fourth transistor T4 and the seventh transistor T7 are turned on, and other transistors are all cut off. The data voltage Vdata is transmitted to the first node N1 through the third transistor T3. Therefore, the voltage of the first node N1 is jumped from the reference voltage Vref in the first period to the data voltage Vdata. Since the fourth transistor T4 is turned on, the gate of the DTFT is coupled to the drain of the DTFT, and a difference between the gate voltage of the DTFT and the source voltage of the DTFT is equal to the threshold voltage of the DTFT. Therefore, the voltage of the second node N2 is jumped to the sum of the voltage of the first level signal V1 and the threshold voltage of the DTFT. In addition, since the seventh transistor T7 is turned on, the reset voltage signal Vinit also resets the anode voltage of the light-emitting diode D1 to the voltage of the reset voltage signal Vinit through the seventh transistor T7 in this period.

It will be understood that, although it is theoretically possible to jump the voltage of the second node N2 to the sum of the voltage of the first level signal V1 and the threshold voltage of the DTFT in the second period (i.e., the threshold voltage of the DTFT can be read). However, in some high-resolution applications, the threshold voltage of the DTFT may not be read because a length of the second period is too small. For example, in a case where a resolution of the display panel is 1440*2560 and a frequency of the display panel is 60 HZ, a read time of the threshold voltage of the DTFT of each pixel is that 1 s divided by 60 HZ divided by 2560 equals 6.5 μs (1 s÷60 HZ÷2560=6.5 μs). In addition, except for the rise time and the fall time of the waveform, the read time of the threshold voltage of the DTFT of each pixel is less than 5 μs, and the higher the resolution, the shorter the read time of the threshold voltage of the DTFT of each pixel. The main function of this period is to read the threshold voltage of the DTFT, therefore this period is also referred to a threshold read period.

In the third period, the fourth scanning signal S4 is at a low level, and the first scanning signal S1, the second scanning signal S2 and the third scanning signal S3 are at a high level. Therefore, the fifth transistor T5 is turned on, and other transistors are all cut off. Since the first transistor T1, the second transistor T2, and the third transistor T3 are all cut off, the first electrode of the first capacitor C1 has no discharge path, and the voltage remains at the data voltage of the previous period. Like in the second period, since the fifth transistor T5 is turned on, the gate of the DTFT is coupled to the drain of the DTFT, and the difference between the gate voltage of the DTFT and the source voltage of the DTFT is equal to the threshold voltage of the DTFT. Therefore, the voltage of the second node N2 is changed to the sum of the voltage of the first level signal V1 and the threshold voltage of the DTFT. The main function of this period is to supplement the read time of the threshold voltage of the DTFT, and therefore this stage is also referred to as a threshold supplementary read period.

Due to an addition of the third period described above, in the embodiments of the present disclosure, the length of time that the pixel circuit reads the threshold voltage of the driver may be increased, thereby solving the problem that the pixel circuit cannot read the threshold voltage of the driver.

In the fourth period, the second scanning signal S2 is at a low level, and the first scanning signal S1, the third scanning signal S3, and the fourth scanning signal S4 are at a high level. Therefore, the second transistor T2 and the eighth transistor T8 are turned on, and other transistors are all cut off. The reference voltage Vref is transmitted to the first node through the second transistor T2, therefore the voltage of the first node N1 becomes the reference voltage Vref. At the same time, according to a law of conservation of charge on the second node N2, the voltage of the second node N2 becomes the difference between the sum of the voltage of the first level signal, the threshold voltage of the driver and the reference voltage, and the data voltage.

A current flowing into the OLED may be obtained from a TFT saturation current formula: $I_{OLED}=K(V_{gs}-V_{th})^2$.

Where $$K=\frac{1}{2}\mu C_{ox}\frac{W}{L},$$

and μ, $C_{ox}$ are constants of the process. W is a width of the channel of the DTFT. L is a length of the channel of the DTFT. $V_{gs}$ is a difference between the gate voltage of the DTFT and the source voltage of the DTFT. $V_{th}$ is the threshold voltage of the DTFT.

Since a gate voltage of the DTFT is equal to the voltage of the second node N2, the gate voltage of the DTFT is:

$$V_g=V1+V_{th}+V\text{ref}-V\text{data}.$$

Where V1 is the voltage of the first level signal. Vref is the voltage of the reference voltage terminal. Vdata is the data voltage.

The source voltage of the DTFT is: $V_s=V1$.

Therefore, the difference between the gate voltage of the DTFT and the source voltage of the DTFT is:

$$V_{gs}=(V1+V_{th}+V\text{ref}-V\text{data})-V1=V_{th}+V\text{ref}-V\text{data},$$

$$I_{OLED}=K(V_{gs}-V_{th})^2=K[(V_{th}+V\text{ref}-V\text{data})-V_{th}]^2=K(V\text{ref}-V\text{data})^2.$$

As can be seen from the above formula, a working current of the OLED is not affected by the threshold voltage of the DTFT, and is only related to the data voltage and the reference voltage. Therefore, a problem of threshold voltage drift of the DTFT due to the process itself and long-time operation may be solved, thereby preventing the problem from affecting the current flowing into the OLED and ensuring a normal operation of the OLED.

Further, all transistors in the pixel circuit in the above embodiments may also be N-type transistors that are turned on when the gates thereof are at a high level. If all the transistors are N-type transistors, it is only necessary to re-adjust the timing state of each scanning signal in the pixel circuit. For example, a first scanning signal in period t1 in FIG. 4 is adjusted to a high level, and a second scanning signal in period t1 in FIG. 4 is adjusted to a low level, and other signals are adjusted to timing signals with opposite phases.

Further, in the above pixel circuit, N-type transistors and P-type transistors may also be used at the same time. In this case, it is necessary to ensure that transistors controlled by a same timing signal or voltage in the pixel circuit are of a same type. Of course, this is a reasonable solution that can be conceived by those skilled in the art according to the embodiments of the present disclosure, and therefore should be within the protection scope of the present disclosure. However, considering that in a manufacturing process of the transistor, different types of transistors adopt different doping materials in the active layer, the use of transistors of a uniform type in the pixel circuit is more advantageous for simplifying the manufacturing process of the pixel circuit.

Figure 5:
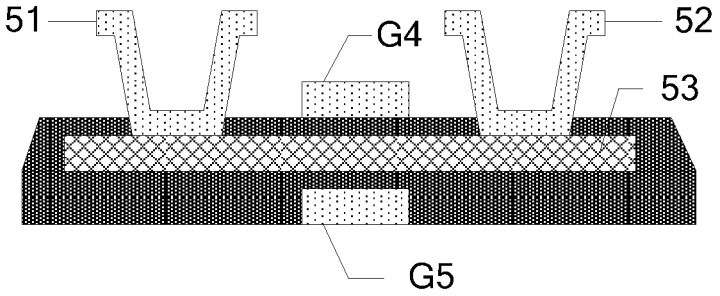
FIG. 5 is a first schematic diagram showing structures of a fourth transistor and a fifth transistor according to embodiments of the present disclosure.

Further, as shown in FIG. 5, the fourth transistor T4 and the fifth transistor T5 in the pixel circuit shown in FIG. 2 may share a source 51, a drain 52, and an active layer 53.

The gate G4 of the fourth transistor T4 and the gate G5 of the fifth transistor T5 are respectively located on both sides of the active layer 53.

For example, the active layer 53 is a polysilicon layer.

It will be noted that, in FIG. 5, an example is taken in which the gate of the fourth transistor T4 is located on an upper side of the active layer 53 and the gate of the fifth transistor T5 is located on a lower side of the active layer 53, but embodiments of the present disclosure are not limited thereto. In some embodiments of the present disclosure, the gate of the fourth transistor T4 is located on the lower side of the active layer 53, and the gate of the fifth transistor T5 is located on the upper side of the active layer 53.

By adopting the design in which the fourth transistor T4 and the fifth transistor T5 share the source 51, the drain 52, and the active layer 53, an area occupied by the transistors in the display panel may be saved, thereby increasing an aperture ratio of the display panel.

Optionally, as shown in FIG. 5, a projection of the gate G4 of the fourth transistor T4 in a direction perpendicular to the active layer 53 and a projection of the gate G5 of the fifth transistor T5 in a direction perpendicular to the active layer 53 coincide with each other.

Since the active layer 53 is sensitive to light intensity, when light inside or outside the display panel is irradiated on the active layer 53, there may be leakage current in the fourth transistor T4 and the fifth transistor T5. Since the projection of the gate G4 of the fourth transistor T4 in the direction perpendicular to the active layer 53 and the projection of the gate G5 of the fifth transistor T5 in a direction perpendicular to the active layer 53 coincide with each other in the embodiments of the present disclosure, the gate G4 of the fourth transistor and the gate G5 of the fifth transistor may serve as a light blocking layer for each other, thereby reducing leakage currents in the fourth transistor T4 and the fifth transistor T5, and ensuring accurate compensation for the threshold voltage of the DTFT.

Further, structures of the fourth transistor T4 and the fifth transistor T5 will be described in detail below with reference to FIG. 6.

Figure 6:
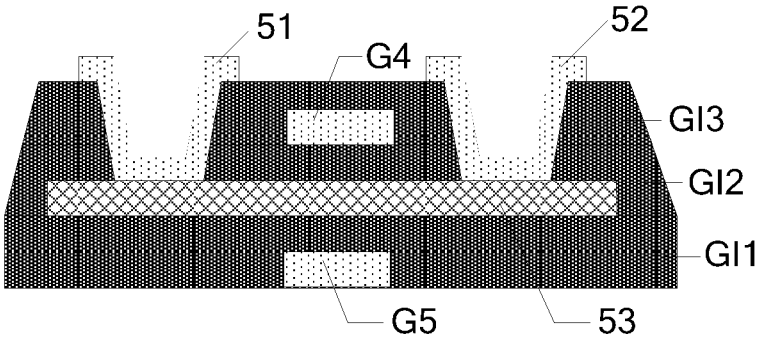
FIG. 6 is a second schematic diagram showing structures of a fourth transistor and a fifth transistor according to embodiments of the present disclosure.

Referring to FIG. 6, a first insulating layer GI1 is further disposed between the gate G5 of the fifth transistor T5 and the active layer 53. A second insulating layer GI2 is further disposed between the gate G4 of the fourth transistor T4 and the active layer 53. A third insulating layer GI3 is further disposed between the gate G4 of the fourth transistor T4 and both the source 51 and the drain 52. The source 51 and the drain 52 are in contact with the active layer 53 through through-holes penetrating the second insulating layer GI2 and the third insulating layer GI3.

In the above embodiments, since the gate G4 of the fourth transistor T4 and the gate G5 of the fifth transistor T5 are not in a same gate metal layer, the gate G4 of the fourth transistor T4 and the gate G5 of the fifth transistor T5 need to be manufactured by patterning processes respectively. This will add more steps to the manufacturing process of the pixel circuit, thereby increasing the manufacturing cost of the pixel circuit. In addition, since a capacitor medium needs to be disposed between two electrodes of the first capacitor C1, the first electrode and the second electrode of the first capacitor C1 also need to be manufactured by patterning processes respectively.

Based on the above process, in embodiments of the present disclosure, the first electrode and the second electrode of the first capacitor C1 are respectively formed with the gate G4 of the fourth transistor T4 and the gate G5 of the fifth transistor T5 by same patterning processes.

That is, it may be that the first electrode of the first capacitor C1 and the gate G4 of the fourth transistor T4 are formed by a same patterning process, and the second electrode of the first capacitor C1 and the gate G5 of the fifth transistor T5 are formed by a same patterning process. It may also be that the second electrode of the first capacitor C1 and the gate G4 of the fourth transistor T4 are formed by a same patterning process, and the first electrode of the first capacitor C1 and the gate G5 of the fifth transistor T5 are formed by a same patterning process.

By adopting the method in which the first electrode and second electrode of the first capacitor C1 are respectively formed with the gate G4 of the fourth transistor T4 and the gate G5 of the fifth transistor T5 by the same patterning processes, steps of the manufacturing process of the pixel circuit may be reduced, and thereby reducing the manufacturing cost of the pixel circuit.

Optionally, the third scanning signal in the foregoing embodiments is an output signal of an nth-stage shift register in a shift register circuit. The fourth scanning signal is an output signal of an (n+1)th-stage shift register in the shift register circuit. N is a positive integer.

In embodiments of the present disclosure, the third scanning signal is substantially a signal received by the third scanning terminal, and the fourth scanning signal is substantially a signal received by the fourth scanning terminal. In any display panel having a plurality of rows of pixel circuits, the nth-stage shift register in the shift register circuit is coupled to third scanning terminals in an nth row of pixel circuits in the display panel. That is, the output signal of the nth-stage shift register in the shift register circuit is a signal received by the third scanning terminals in the nth row of the pixel circuits in the display panel. The (n+1)th-stage shift register in the shift register circuit is coupled to fourth scanning terminals in the nth row of pixel circuits in the display panel. That is, the output signal of the (n+1)th-stage shift register in the shift register circuit is a signal received by the fourth scanning terminals in the nth row of pixel circuits in the display panel.

By using output signals of the shift register circuit as the third scanning signal S3 and the fourth scanning signal S4, a process and cost of separately manufacturing driving circuits of the third scanning terminal S3 and the fourth scanning terminal S4 are eliminated, thereby further simplifying the manufacturing process of the pixel circuit and reducing the manufacturing cost of the pixel circuit.

Figure 7:
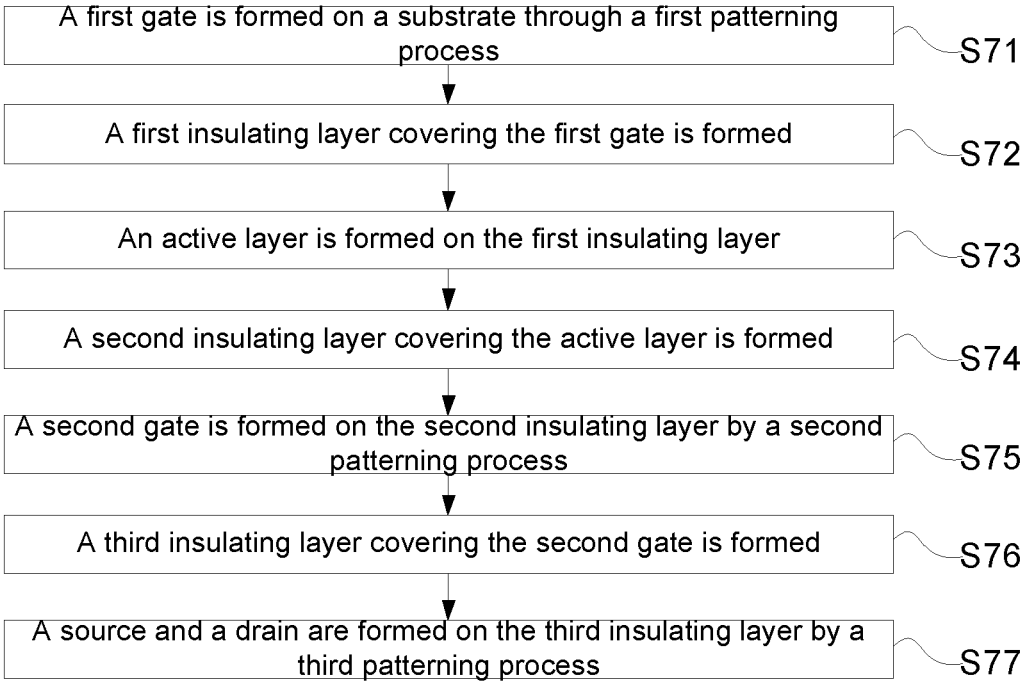
FIG. 7 is a flow chart of a method of manufacturing a pixel circuit according to embodiments of the present disclosure.

Embodiments of the present disclosure further provide a method of manufacturing a pixel circuit for manufacturing the fourth transistor T4 and the fifth transistor T5 in any of the pixel circuits described above. Referring to FIG. 7, the method includes following steps.

At S71, a first gate is formed on a substrate through a first patterning process.

The first patterning process mainly includes film forming, coating, exposure, development, etching, and stripping. Film forming refers to a process of forming a thin film of a base material on a substrate by magnetron sputtering, evaporation, chemical deposition, etc. Coating refers to a process of coating photoresist on the formed thin film of the base material. Exposure refers to a process of exposing a specified position of the photoresist using a mask. Development refers to a process of removing the photoresist that has undergone a chemical reaction to produce a desired film pattern on a glass. Etching refers to a process of etching away a portion of the thin film of the base material that is not covered by the photoresist. Stripping refers to a process of removing the photoresist film after the etching. Of course, the patterning process may also include a substrate cleaning step and a pattern inspection step. In embodiments of the present disclosure, steps included in the patterning process and an order of the steps are not limited, as long as the first gate can be formed.

At S72, a first insulating layer covering the first gate is formed.

At S73, an active layer is formed on the first insulating layer.

At S74, a second insulating layer covering the active layer is formed.

At S75, a second gate is formed on the second insulating layer by a second patterning process.

At S76, a third insulating layer covering the second gate is formed.

At S77, a source and a drain are formed on the third insulating layer by a third patterning process, wherein the source and the drain are in contact with the active layer through through-holes penetrating the second insulating layer and the third insulating layer.

For example, embodiments of the present disclosure further provide a method of manufacturing a pixel circuit for manufacturing the first transistor T1 to the third transistor T3 and the sixth transistor T6 to the eighth transistor T8 in any of the pixel circuits described above. The method includes following steps.

At S81, gates of the first to third transistors T1~T3 and gates of the sixth to eighth transistors T6~T8 are formed at the same time when the first gate is formed on the substrate by a first patterning process.

At S82, the first insulating layer is formed to also cover the gates of the first to third transistors T3, and the gates of the sixth to eighth transistors T6~T8 when the first insulating layer covering the first gate is formed.

At S83, active layers of the first to third transistors T1~T3 and active layers of the sixth to eighth transistors T6~T8 are formed at the same time when the active layer is formed on the first insulating layer.

S84, the second insulating layer is formed to also cover the active layers of the first to third transistors T1~T3 and the active layers of the sixth to eighth transistors T6~T8 when the second insulating layer covering the active layer is formed.

It will be noted that, in embodiments of the present disclosure, in S75, the second gate is only formed at a position on the second insulating layer corresponding to the first gate. The second gate is not formed at positions on the second insulating layer corresponding to the gates of the first to third transistors T1~T3, and at positions on the second insulating layer corresponding to the gates of the sixth to eighth transistors T6~T8.

At S85, the third insulating layer is formed to only cover the second gate when the third insulating layer covering the second gate is formed. Alternatively, the third insulating layer is formed to also cover the second insulating layers of the first to third transistors T1~T3, and the second insulating layers of the sixth to eighth transistors T6~T8, when the third insulating layer covering the second gate is formed.

At S86, sources and drains of the first to third transistors T1~T3, and sources and drains of the sixth to eighth transistors T6~T8 are formed at the same time when the source and the drain are formed on the third insulating layer.

It will be added that, in some embodiments of the present disclosure, if the third insulating layer formed in S85 only covers the second gate, then in S86, sources and drains of the first to third transistors T1~T3, and sources and drains of the sixth to eighth transistors T6~T8 may be formed on the second insulating layer covering the active layers of the first to third transistors T1~T3, and the active layers of the sixth to eighth transistors T6~T8 at the same time when the source and the drain are formed on the third insulating layer. Each source and each drain are in contact with a respective active layer through through-holes penetrating the second insulating layer.

In some other embodiments of the present disclosure, if the third insulating layer formed in S85 covers the second insulating layer covering the active layers of the first to third transistors T1~T3 and the active layers of the sixth to eighth transistors T6~T8, then in S86, sources and drains of the first to third transistors T1~T3, and sources and drains of the sixth to eighth transistors T6~T8 may be formed on the third insulating layer covering the second insulating layer covering the active layers of the first to third transistors T1~T3 and the active layers of the sixth to eighth transistors T6~T8 at the same time when the source and the drain are formed on the third insulating layer. Each source and each drain are in contact with a respective active layer through through-holes penetrating the second insulating layer and the third insulating layer.

In embodiments of the present disclosure, the first gate may be the gate G4 of the fourth transistor T4, or the gate G5 of the fifth transistor T5.

Optionally, the above method of manufacturing a pixel circuit further includes:

forming the first electrode of the first capacitor by the first patterning process, and forming the second electrode of the first capacitor by the second patterning process;

or forming the second electrode of the first capacitor by the first patterning process, and forming the first electrode of the first capacitor by the second patterning process.

Some embodiments of the present disclosure provide a display panel, which includes any one of the pixel circuits in the embodiments described above.

Moreover, the display panel may be an electronic paper, a mobile phone, a tablet computer, a television, a display, a notebook computer, a digital photo frame, a navigator, or any other product or component having a display function.

The foregoing descriptions are merely some implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subjected to the protection scope of the claims.

What is claimed is:

1. A pixel circuit, comprising a node control circuit, a driver, a display sub-circuit, a threshold compensator, and a reset device, wherein the node control circuit is configured to receive a first scanning signal, a second scanning signal, a third scanning signal, a reference voltage, and a data voltage; the node control circuit is further configured to output the reference voltage to a first node under control of a voltage of the first scanning signal or a voltage of the second scanning signal, or to output the data voltage to the first node under control of a voltage of the third scanning signal;

the driver is configured to receive a first level signal at an input terminal of the driver; a control terminal of the driver is coupled to a second node; and the driver is further configured to output a driving current at an output terminal of the driver under control of a voltage of the first level signal and a voltage of the second node;

the display sub-circuit is coupled to the reset device and the output terminal of the driver, the display sub-circuit is configured to receive a second level signal and the second scanning signal, and the display sub-circuit is further configured to display a gray-scale by the driving current under control of the voltage of the second scanning signal;

the threshold compensator is coupled to the first node, the output terminal of the driver, and the second node; the threshold compensator is configured to receive the third scanning signal and a fourth scanning signal; the threshold compensator is further configured to adjust the voltage of the second node to a sum of the voltage of the first level signal and a threshold voltage of the driver under control of the voltage of the third scanning signal or a voltage of the fourth scanning signal, and to adjust the voltage of the second node to a difference between a sum of the voltage of the first level signal, the threshold voltage of the driver and the reference voltage, and the data voltage under control of a voltage of the first node and a voltage of the output terminal of the driver;

the reset device is coupled to the second node and the display sub-circuit; the reset device is configured to receive a reset voltage signal, the first scanning signal and the third scanning signal; the reset device is further configured to reset the second node by a voltage of the reset voltage signal under control of the voltage of the first scanning signal, and to reset the display sub-circuit by the voltage of the reset voltage signal under control of the voltage of the third scanning signal;

the first node is an intersection of an output of the node control circuit and an input of the threshold compensator; and the second node is an intersection of an output of the threshold compensator, an input of the driver, and an output of the reset device.

2. The pixel circuit according to claim 1, wherein the node control circuit comprises a first transistor, a second transistor, and a third transistor;

the first transistor is configured to receive the reference voltage at a first electrode of the first transistor, a second electrode of the first transistor is coupled to the first node, and the first transistor is configured to receive the first scanning signal at a gate of the first transistor;

the second transistor is configured to receive the reference voltage at a first electrode of the second transistor, a second electrode of the second transistor is coupled to the first node, and the second transistor is configured to receive the second scanning signal at a gate of the second transistor;

the third transistor is configured to receive the data voltage at a first electrode of the third transistor, a second electrode of the third transistor is coupled to the first node, and the third transistor is configured to receive the third scanning signal at a gate of the third transistor.

3. The pixel circuit according to claim 1, wherein the threshold compensator comprises a fourth transistor, a fifth transistor, and a first capacitor;

a first electrode of the fourth transistor is coupled to the output terminal of the driver, a second electrode of the fourth transistor is coupled to the second node, and the fourth transistor is configured to receive the third scanning signal at a gate of the fourth transistor;

a first electrode of the fifth transistor is coupled to the output terminal of the driver, a second electrode of the fifth transistor is coupled to the second node, and the fifth transistor is configured to receive the fourth scanning signal at a gate of the fifth transistor;

a first electrode of the first capacitor is coupled to the first node, and a second electrode of the first capacitor is coupled to the second node.

4. The pixel circuit according to claim 3, wherein the fourth transistor and the fifth transistor share a source, a drain, and an active layer; and the gate of the fourth transistor and the gate of the fifth transistor are respectively located on both sides of the active layer.

5. The pixel circuit according to claim 4, wherein a projection of the gate of the fourth transistor in a direction perpendicular to the active layer and a projection of the gate of the fifth transistor in the direction perpendicular to the active layer coincide with each other.

6. The pixel circuit according to claim 4, wherein a first insulating layer is further disposed between the gate of the fifth transistor and the active layer; a second insulating layer is further disposed between the gate of the fourth transistor and the active layer; a third insulating layer is further disposed between the gate of the fourth transistor and both the source and the drain; and the source and the drain are in contact with the active layer through through-holes penetrating the second insulating layer and the third insulating layer.

7. The pixel circuit according to claim 4, wherein the first electrode of the first capacitor and the gate of the fourth transistor are formed by a same patterning process, and the second electrode of the first capacitor and the gate of the fifth transistor are formed by a same patterning process.

8. The pixel circuit according to claim 4, wherein the first electrode of the first capacitor and the gate of the fifth transistor are formed by a same patterning process, and the second electrode of the first capacitor and the gate of the fourth transistor are formed by a same patterning process.

9. The pixel circuit according to claim 1, wherein the reset device comprises a sixth transistor and a seventh transistor;

the sixth transistor is configured to receive the reset voltage signal at a first electrode of the sixth transistor, a second electrode of the sixth transistor is coupled to the second node, and the sixth transistor is configured to receive the first scanning signal at a gate of the sixth transistor;

the seventh transistor is configured to receive the reset voltage signal at a first electrode of the seventh transistor, a second electrode of the seventh transistor is coupled to the display sub-circuit, and the seventh transistor is configured to receive the third scanning signal at a gate of the seventh transistor.

10. The pixel circuit according to claim 1, wherein the driver is a driving transistor, the input terminal of the driver is a source of the driving transistor, the control terminal of the driver is a gate of the driving transistor, and the output terminal of the driver is a drain of the driving transistor.

11. The pixel circuit according to claim 1, wherein the display sub-circuit comprises an eighth transistor and a light-emitting diode;

a first electrode of the eighth transistor is coupled to the output terminal of the driver, a second electrode of the eighth transistor is coupled to an anode of the light-emitting diode, and the eighth transistor is configured to receive the second scanning signal at a gate of the eighth transistor; and the light-emitting diode is configured to receive the second level signal at a cathode of the light-emitting diode.

12. The pixel circuit according to claim 1, wherein the third scanning signal is an output signal of an nth-stage shift register in a shift register circuit; the fourth scanning signal is an output signal of an (n+1)th-stage shift register in the shift register circuit; and n is a positive integer.

13. A method of driving a pixel circuit for driving the pixel circuit according to claim 1, the method comprising:

in a first period, outputting, by the node control circuit, the reference voltage to the first node under the control of the voltage of the first scanning signal; and resetting, by the reset device, the second node by the voltage of the reset voltage signal under the control of the voltage of the first scanning signal;

in a second period, outputting, by the node control circuit, the data voltage to the first node under the control of the voltage of the third scanning signal; adjusting, by the threshold compensator, the voltage of the second node to the sum of the voltage of the first level signal and the threshold voltage of the driver; and resetting, by a reset device, the display sub-circuit by the voltage of the reset voltage signal under the control of the voltage of the third scanning signal;

in a third period, adjusting, by the threshold compensator, the voltage of the second node to the sum of the voltage of the first level signal and the threshold voltage of the driver under the control of the voltage of the fourth scanning signal; and in a fourth period, outputting, by the node control circuit, the reference voltage to the first node under the control of the voltage of the second scanning signal; adjusting, by the threshold compensator, the voltage of the second node to the difference between the sum of the voltage of the first level signal, the threshold voltage of the driver and the reference voltage, and the data voltage under the control of the voltage of the first node and the voltage of the output terminal of the driver; outputting, by the driver, the driving current at the output terminal of the driver under the control of the voltage of the first level signal and the voltage of the second node; and driving, by the display sub-circuit, to display a gray-scale by the driving current under the control of the voltage of the second scanning signal.

14. A display panel, comprising pixel circuits according to claim 1.

15. The display panel according to claim 14, comprising a shift register circuit, wherein the third scanning signal of one of the pixel circuits is an output signal of an nth-stage shift register in the shift register circuit; the fourth scanning signal of the one of the pixel circuits is an output signal of an (n+1)th-stage shift register in the shift register circuit; and n is a positive integer.

* * * * *